US011187492B2

(12) United States Patent
Mumford

(10) Patent No.: US 11,187,492 B2
(45) Date of Patent: Nov. 30, 2021

(54) MODULAR COMPACT FIREARM SYSTEM

(71) Applicant: Henry Hanson Mumford, Columbia Falls, MT (US)

(72) Inventor: Henry Hanson Mumford, Columbia Falls, MT (US)

( * ) Notice: Subject to any disclaimer, the term of this patent is extended or adjusted under 35 U.S.C. 154(b) by 64 days.

(21) Appl. No.: 16/852,455

(22) Filed: Apr. 18, 2020

(65) Prior Publication Data

US 2021/0325141 A1 Oct. 21, 2021

(51) Int. Cl.

| | |
|---|---|
| ***F41C 3/00*** | (2006.01) |
| ***F41C 23/04*** | (2006.01) |
| ***F41C 23/10*** | (2006.01) |
| *F41C 27/00* | (2006.01) |

(52) U.S. Cl.

CPC ..... *F41C 3/00* (2013.01); *F41C 23/04* (2013.01); *F41C 23/10* (2013.01); *F41C 27/00* (2013.01)

(58) Field of Classification Search

CPC .. F41C 3/00; F41C 23/04; F41C 23/10; F41C 27/00; F41A 11/00; F41A 11/02; F41A 3/66

See application file for complete search history.

(56) References Cited

U.S. PATENT DOCUMENTS

| | | | | |
|---|---|---|---|---|
| 7,194,836 | B1 * | 3/2007 | Urban | F41C 27/22 42/106 |
| 8,528,243 | B1 * | 9/2013 | Glock | F41A 3/66 42/75.02 |
| 8,950,100 | B2 * | 2/2015 | Nebeker | F41A 35/00 42/108 |
| D784,479 | S * | 4/2017 | Niswander | D22/108 |
| D883,413 | S * | 5/2020 | Wilson | D22/108 |
| 10,866,058 | B2 * | 12/2020 | Maeda | F41A 11/00 |
| 10,876,806 | B2 * | 12/2020 | Lee | F41A 19/10 |
| D910,796 | S * | 2/2021 | Jen | D22/108 |
| 10,941,998 | B1 * | 3/2021 | Fan | F41A 21/36 |
| 10,955,204 | B2 * | 3/2021 | Harrigan | F41A 11/00 |
| 2002/0116857 | A1 * | 8/2002 | Wonisch | F41A 3/64 42/75.02 |
| 2005/0257413 | A1 * | 11/2005 | Zimmermann | F41A 11/02 42/75.1 |
| 2009/0071053 | A1 * | 3/2009 | Thomele | F41A 15/12 42/1.01 |
| 2009/0282718 | A1 * | 11/2009 | Bartley | F41C 23/12 42/75.03 |
| 2014/0196337 | A1 * | 7/2014 | Bandini | F41A 3/78 42/16 |
| 2015/0316336 | A1 * | 11/2015 | Lee | F41A 19/35 42/16 |
| 2016/0061558 | A1 * | 3/2016 | Gilmer | F41C 23/12 42/71.02 |
| 2016/0320154 | A1 * | 11/2016 | Krieger | F41A 17/64 |

(Continued)

*Primary Examiner* — Joshua E Freeman

(57) ABSTRACT

An assembly for a modular, compact firearm includes a universal action and an interchangeable, non-reciprocating barrel. The barrel may directly mount various optical sighting systems and provide integral muzzle compensation and sound suppression capabilities. The firearm utilizes a universal action comprised of a slide assembly, breechblock assembly, recoil assembly, and receiver which mounts a variety of barrel assemblies and assembles into a variety of different grip frames. The action of the firearm utilizes a partially-locked breechblock which amplifies the inertia of a slide.

20 Claims, 6 Drawing Sheets

(56) References Cited

U.S. PATENT DOCUMENTS

| | | | | |
|---|---|---|---|---|
| 2017/0191769 | A1* | 7/2017 | Martindill | F41A 3/86 |
| 2017/0198993 | A1* | 7/2017 | Dechant | F41C 3/00 |
| 2017/0205178 | A1* | 7/2017 | Niswander | F41A 3/66 |
| 2017/0254613 | A1* | 9/2017 | Kedairy | F41C 23/12 |
| 2019/0041164 | A1* | 2/2019 | Hughes | F41A 3/66 |
| 2019/0093983 | A1* | 3/2019 | Bruegger | F41A 3/66 |
| 2019/0101345 | A1* | 4/2019 | Fellows | F41A 3/66 |
| 2019/0107348 | A1* | 4/2019 | Harrigan | F41A 5/02 |
| 2019/0107363 | A1* | 4/2019 | Harrigan | F41A 11/00 |
| 2019/0154369 | A1* | 5/2019 | Kim | F41C 23/10 |
| 2019/0195582 | A1* | 6/2019 | Thomele | F41A 3/72 |
| 2019/0195587 | A1* | 6/2019 | Thomele | F41A 11/00 |
| 2019/0226798 | A1* | 7/2019 | Faifer | F41C 27/22 |
| 2019/0323795 | A1* | 10/2019 | Zimmer | F41C 23/04 |
| 2020/0158458 | A1* | 5/2020 | Faifer | F41C 23/12 |
| 2020/0232731 | A1* | 7/2020 | Sharkov | F42B 5/10 |
| 2021/0063103 | A1* | 3/2021 | Becklin | F41A 3/72 |
| 2021/0071977 | A1* | 3/2021 | Lee | F41A 19/15 |
| 2021/0116193 | A1* | 4/2021 | Tai | F41A 3/66 |
| 2021/0116208 | A1* | 4/2021 | Tai | F41A 19/06 |

* cited by examiner

MODULAR COMPACT FIREARM SYSTEM

FIELD OF THE DISCLOSURE

The present disclosure relates to firearms and particularly to modular pistol caliber firearms configurable to suit different applications.

BACKGROUND

Modern semi-automatic pistols utilize, by-and-large, a short-recoil action descended from the designs of J. M. Browning and improved over the decades to increase manufacturability and functionality. This system is adequate to meet the historical usage requirements of pistols. However, several trends in pistol use have emerged that put the Browning tilt-barrel action at a disadvantage. First, the growing popularity of sound suppressors among military, police, and civilian users requires the additional use of a linear inertial decoupler to reduce interference of the suppressor on the pistol's short-recoil action. Second, the precept of electro-optical sight use on pistols requires the optic unit to be either mounted via an unwieldly cantilever from the pistol's frame or directly on the reciprocating slide, altering the momentum balance of the short-recoil action and subjecting the optic to harsh accelerations. Third, the distinction between pistol and carbine is diminishing. As pistol-caliber carbines surge in popularity, there is an increasing demand for pistols with modular capabilities where specifications can be altered easily by the end user by swapping components, including but not limited to changing the configuration of the weapon from a handgun to a personal-defense-weapon style carbine. The present invention describes a compact firearm aimed at maximizing functionality related to all three trends above.

SUMMARY

The present invention describes a modular compact firearm system with a non-reciprocating, interchangeable barrel, interchangeable grip frames, and universal action system.

According to one aspect, there is a receiver that provides locking surfaces, guide rails, and mounts the barrel assembly and fire control components.

According to another aspect, the receiver is assembled into a variety of grip frames providing different features.

According to a further aspect, there is provided a partially locked breechblock assembly disposed in a slide assembly.

According to yet another aspect, the slide assembly and receiver assembly comprise a universal action system.

According to yet another aspect, there are provided a variety of interchangeable barrel assemblies and grip assemblies providing different features.

DETAILED DESCRIPTION

Figure 1:
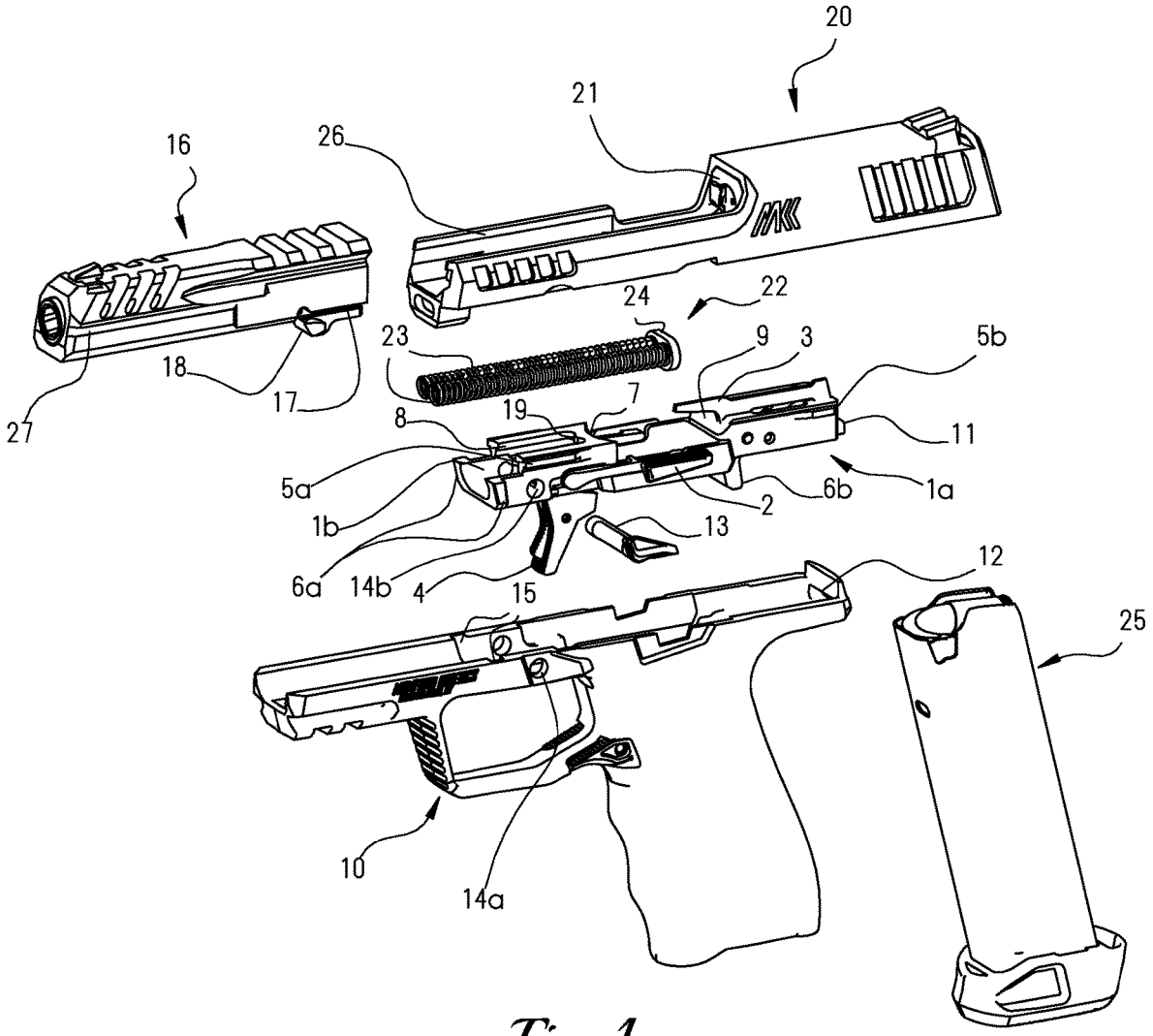
FIG. 1 shows a compact firearm, configured as a pistol, in an exploded view.

For the purposes of conveying understanding of this invention, embodiments of the invention will be described as depicted in the drawing. However, the drawings suggest merely embodiments of the invention and do not limit the scope of the invention.

Figure 2:
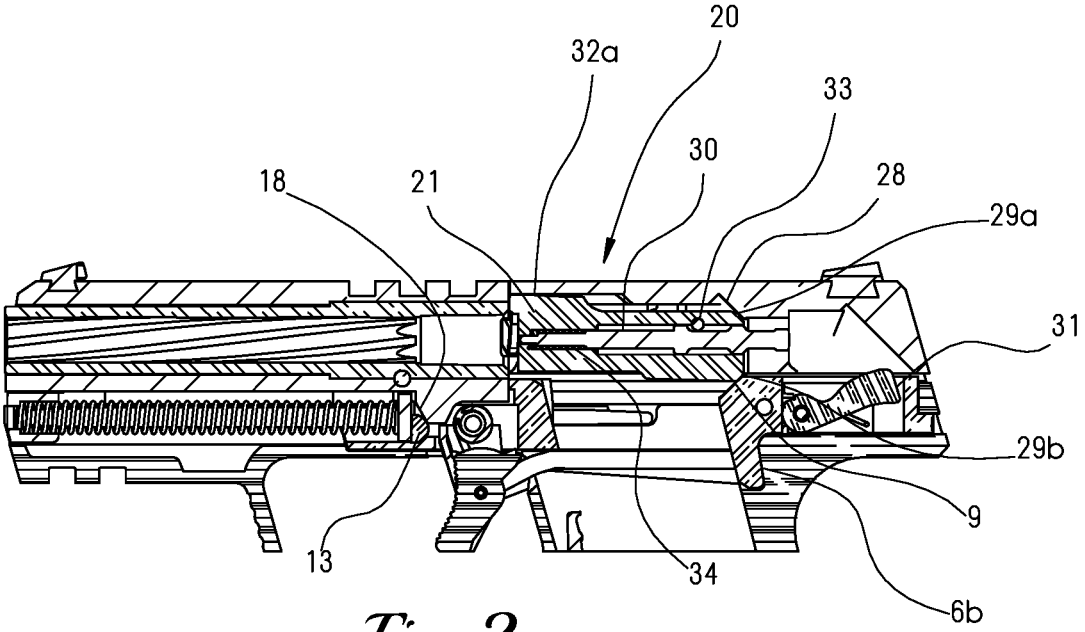
FIG. 2 shows a cross section of the action of said firearm in its locked or in-battery state.
Figure 3:
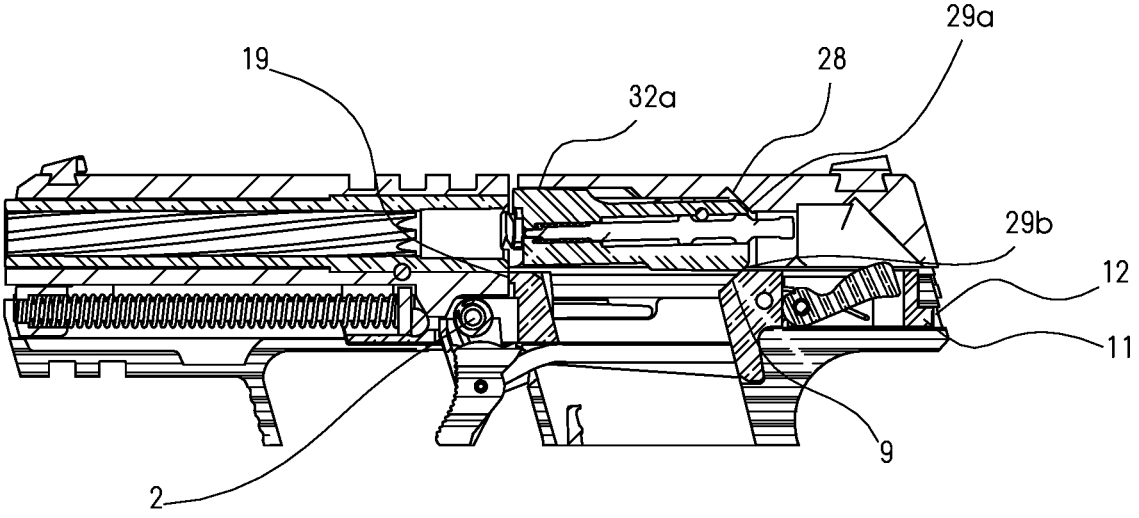
FIG. 3 shows a cross section of the action of said firearm as the breechblock has just finished unlocking.
Figure 4:
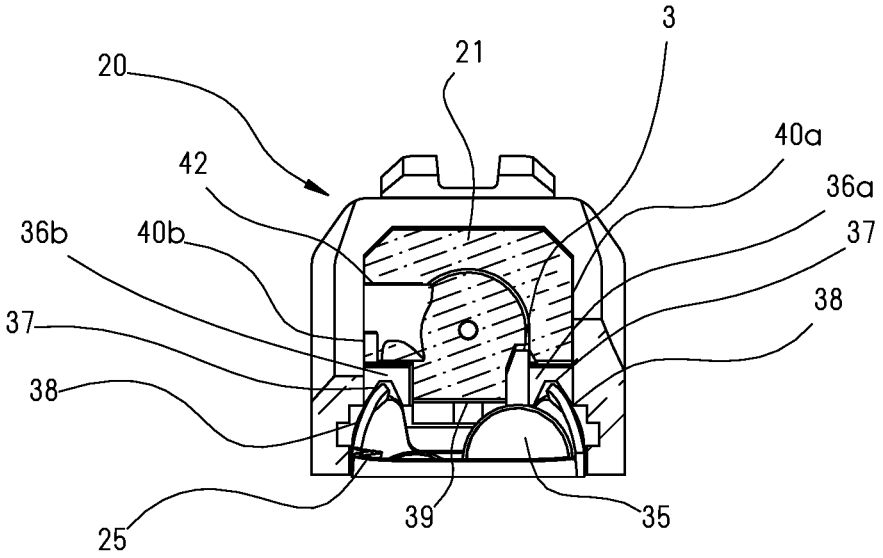
FIG. 4 shows a cross section of the slide and breechblock of said firearm.
Figure 5:
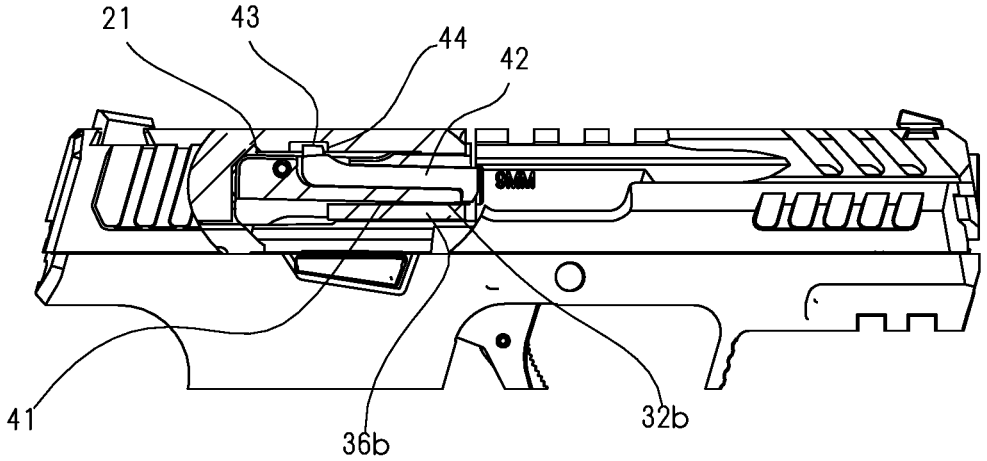
FIG. 5 shows a break-open view of the extractor and breechblock of the action of said firearm.
Figure 6:
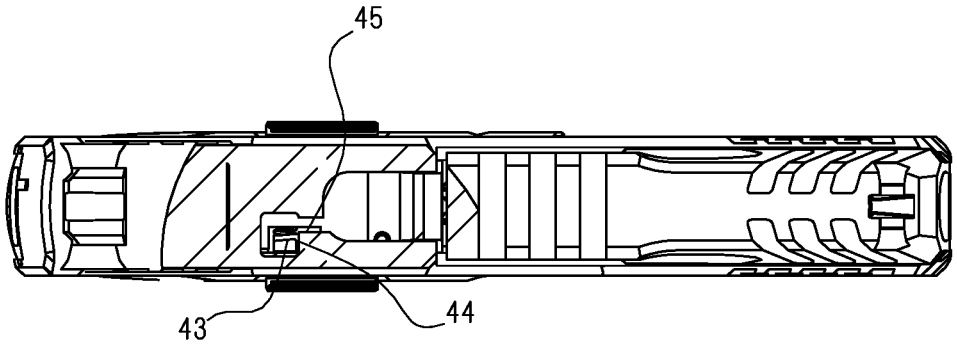
FIG. 6 shows a top down break-open view of the extractor and upper faces of the slide.
Figure 7:
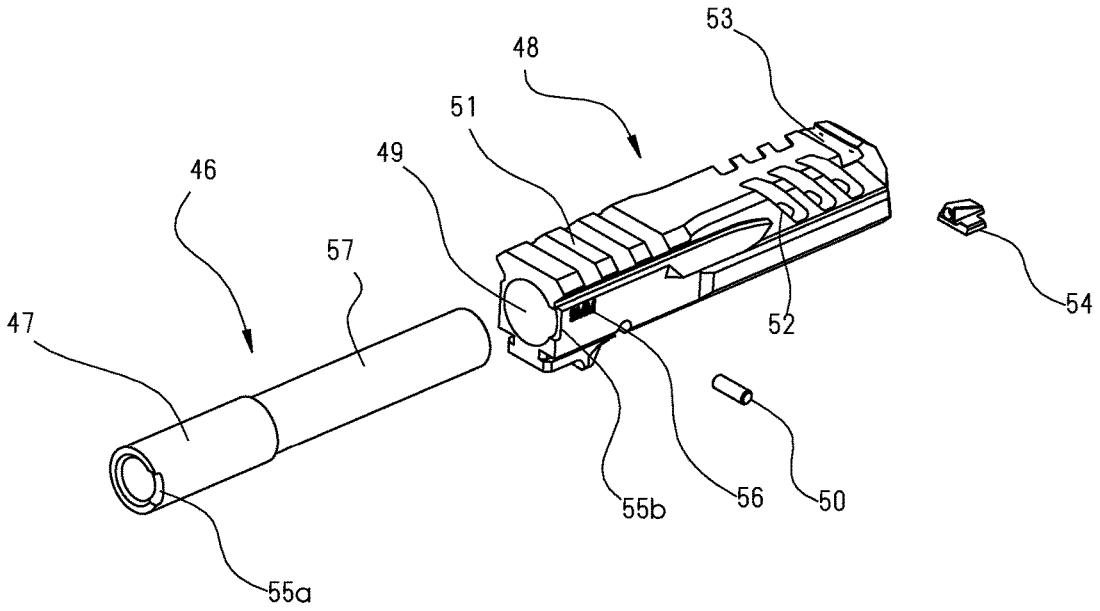
FIG. 7 shows an exploded barrel assembly belonging to said firearm.
Figure 8:
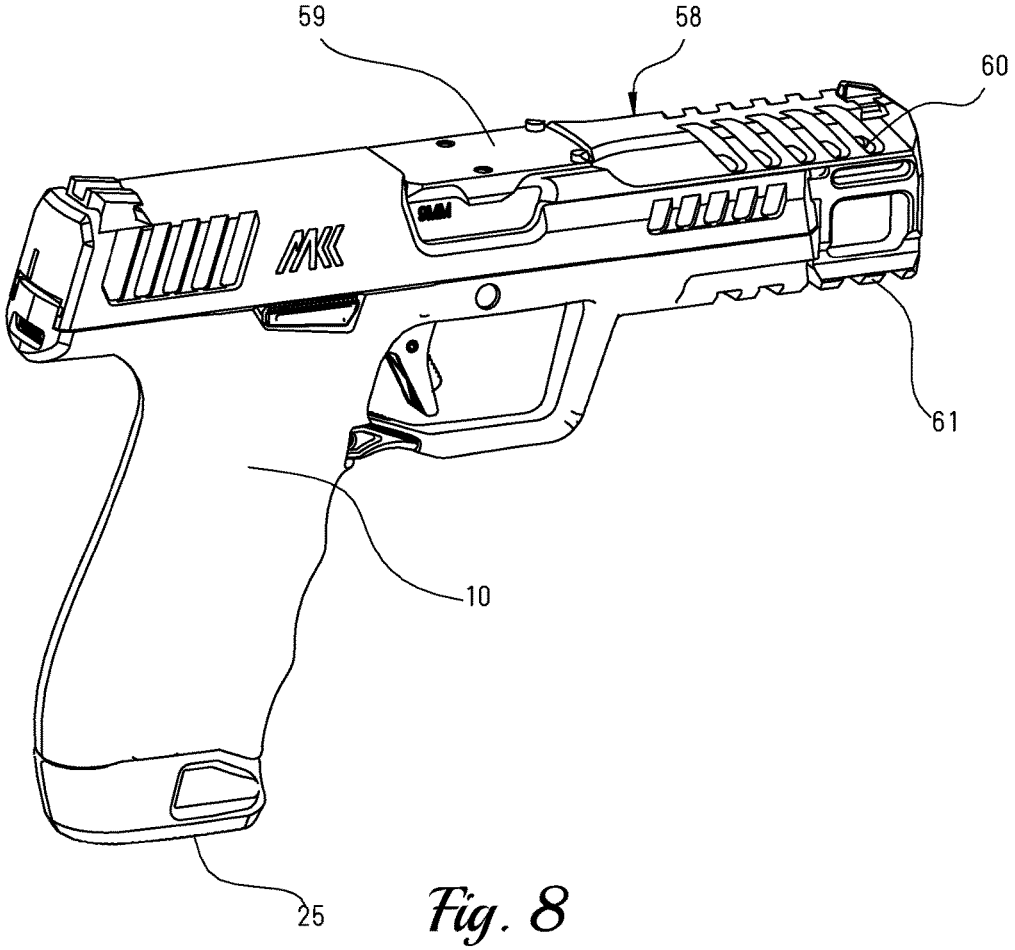
FIG. 8 shows said firearm configured as a full-size pistol.
Figure 9:
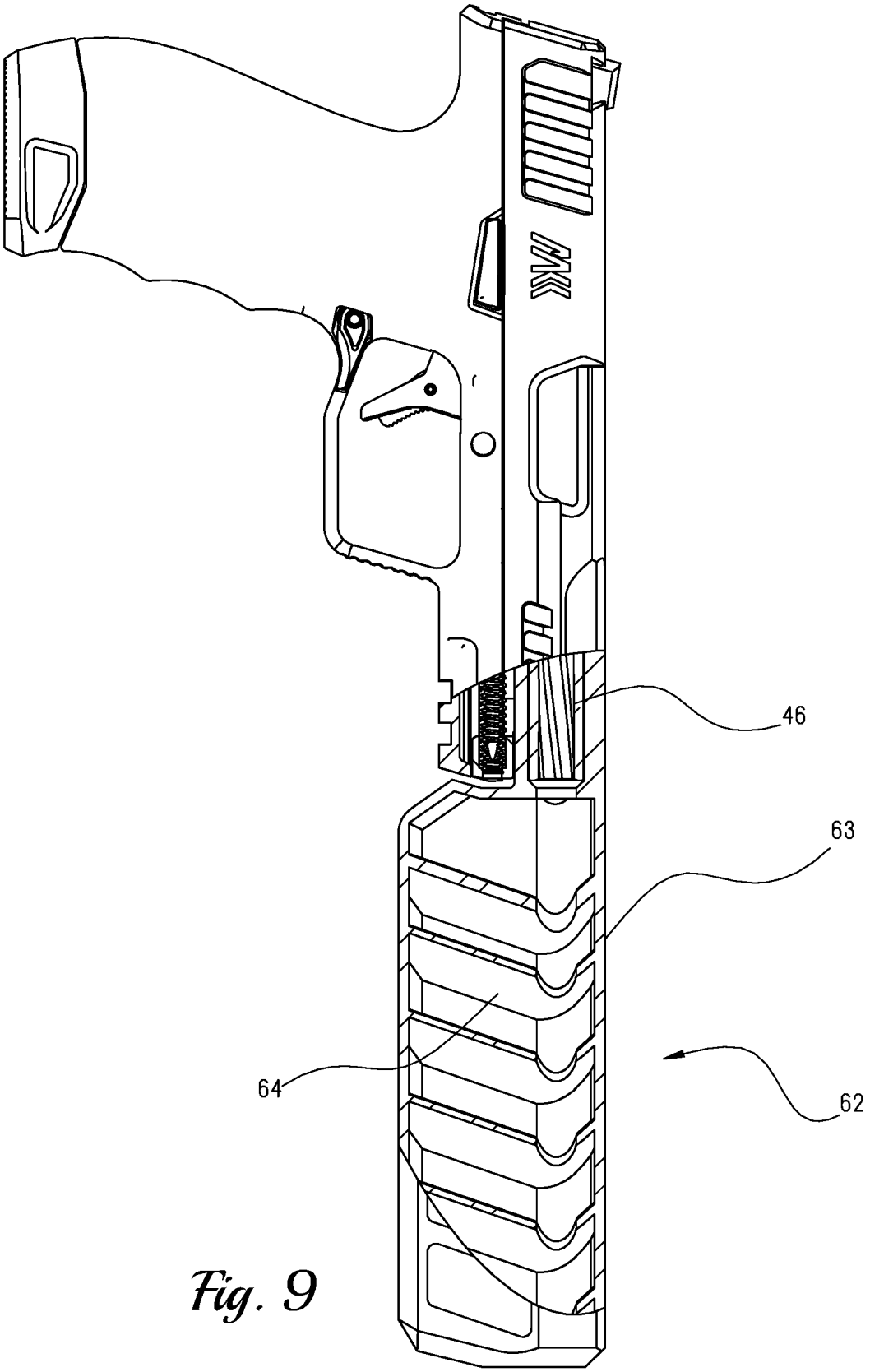
FIG. 9 shows said firearm configured as an integrally sound suppressed pistol.
Figure 10:
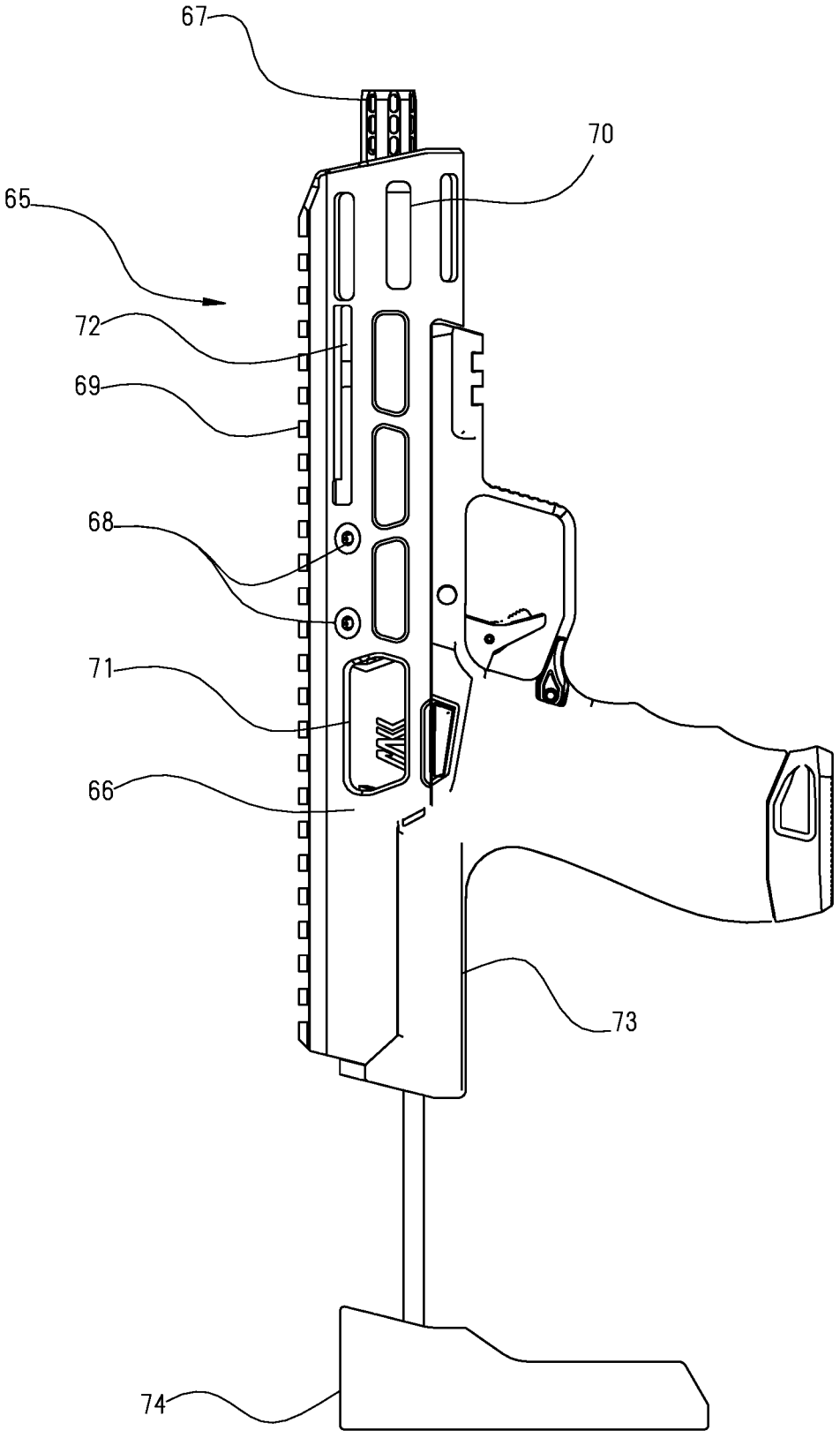
FIG. 10 shows said firearm configured as a subcarbine.

FIG. 1 shows a compact firearm, configured as a pistol, in an exploded view. The receiver assembly 1*a* contains a monolithic chassis-style receiver 1*b*, housing a slide stop 2, ejector 3, trigger assembly 4, and further fire control components. Integral to the receiver are bilaterally disposed forward and rear slide rails 5*a* & 5*b*, recoil lugs 6*a* & 6*b*, feed ramp 7, barrel mounting rails 8, and breechblock lock surface 9. The receiver is mounted to the grip frame 10 by means of the rear tab 11 which is inserted in slot 12 and takedown lever 13 which is inserted through holes 14*a* and 14*b* in the grip frame 10 and receiver 1*b* respectively. Recoil lugs 6*a* fit within recesses 15 in the grip frame 10, preferably with a light interference fit. The barrel assembly 16 mounts to the bilaterally disposed receiver rails 8 with matching tracks 17, and stops forward against the diameter of the takedown lever 13 on lock face 18 and rearward against face 19 in the receiver 1*b*. Further comprising the firearm are a slide assembly 20, having disposed therein a breechblock assembly 21, a recoil spring assembly 22 comprising in the preferred embodiment two helical compression springs 23 in parallel disposed about the shafts of a unitary dual guide rod 24, and a magazine assembly 25. In this embodiment, the slide 20 has bilaterally disposed rails 26 that slide in matching tracks 27 on the barrel assembly, which serve in this embodiment only to retain the barrel assembly in the slide assembly during field stripping of the firearm, i.e. separating the slide assembly 20 from the receiver assembly 1*a*. The universal action disclosed in the invention is comprised of the receiver assembly 1*a*, slide assembly 20, and recoil spring assembly 22, which is configured to accept a plurality of different barrel assemblies and install in a plurality of different grip assemblies in order to provide the firearm with different characteristics. A cross section of an assembled firearm in battery is shown in FIG. 2. In battery, a planar angled camming face 28 of the slide pushes bearing face 29*a* of the breechblock 21 forward against the barrel assembly 16 and cartridge and thusly tends bearing face 29*b* down against a similar planar angled locking face 9 on the receiver 1*b*. Undergoing firing forces, bearing face 29*b* cams up face 9, pitching the breechblock 21 with respect to the bore axis to an angle between 1 and 3 degrees, shown in FIG. 3. The breechblock 21 tilt cams the slide 20 backwards at a ratio roughly equal to the product of the tangent of the first angle and the cotangent of the second angle plus one, such that the slide 20 has moved relatively rearwards to the breechblock 21. Thus it can be said that the breechblock 21 has amplified the inertia of the slide 20, resulting in an artificially increased inertia resisting the force of the cartridge being fired. This results in a blowback firearm requiring less reciprocating mass to achieve the desired peak slide velocity than a direct blowback system. It should be noted that although 9 is referred to as a locking face, a delayed blowback system is not truly mechanically locked, and is sometimes referred to as partially-locked, as the locked state is still useful to refer to as comparison with the unlocked or unleveraged state, firing under which conditions would produce unacceptably high slide velocities and possibly pressure excursion from the case. The optimization of these angles can be accomplished with iterative kinematic analysis or multibody physics simulation to achieve a desired peak slide velocity that is reasonable to those skilled in the art while minimizing subsurface shear on the bearing contacts 29. The geometry should also be designed to minimize the angle through which the breechblock 21 tilts, as the method of operation will necessarily introduce angular misalignment between the breech face and the pressurized cartridge head, which can only tolerate a few degrees of angular misalignment at peak pressure. Furthermore, the geometry should be optimized to reduce sensitivity of the mechanism to variations due to tolerancing and identify the permissible tolerance range relating to bearing faces 29, locking face 9, and camming face 28. The firing pin 30 is housed in the breechblock 21 and struck by a rotating hammer 31, however a linear hammer may also be utilized. The breechblock 21 tilts about the theoretical axis formed by radial contact face 32*a* and 32*b* which constrain the breechblock 21 inside the slide. The firing pin retaining pin 33 traps the firing pin 30 within the breechblock 21, which is biased to the rear by means of firing pin reset spring 34. Due to the direction in which the breechblock 21 tilts to lock, the mechanism is vulnerable to pressure from the cartridge stack 35 in the magazine 25 acting on the bottom of the breechblock 21, which could partially or fully unlock the action depending on the force of the magazine spring. The bottom of the breechblock 21 could be clearanced out, leaving a feeding lug 39 to protrude under the breech face, but it is undesirable to rapidly compress the cartridge stack with every cycle, as this introduces friction and variation to operating velocity. It can also damage the magazine spring through cycle fatigue and put undue stress on magazine 25 and latch components. To avoid this, locking face 9 could alternatively be located above the bore axis in a rearward extension of the barrel shroud 48, and slide camming face 28 could be located below the bore axis, reversing the direction of breechblock 21 tilt. However, this would increase the required size of the slide or require the slide to be open on the top, reducing the gripping area for cocking the firearm. These outcomes are ergonomically undesirable. In the preferred embodiment, the slide 20 is formed to shield the breechblock 21 from magazine pressure. FIG. 4 shows a cross section of the breechblock housed in the slide 20 above the magazine 25. Bosses 36*a* and 36*b* are formed to provide clearances 37 for the magazine feed lips 38, and terminate below the feeding lug 39 of the breechblock 21. In this embodiment, the magazine 25 is configured as a double-stack double-feed magazine. This configuration is more common in rifle and submachine gun magazines but is nevertheless utilized in a small number of pistols such as the Stechkin APS, Gryazev Shipunov GSh-18, Steyr GB, and Heckler & Koch VP70Z. This configuration may hold slightly more cartridges for the same length as a conventional single feed pistol magazine and is more reliable due to the absence of a convergence section and associated reaction forces and frictional forces. Beyond the functional advantages, this configuration is also preferable in this embodiment due to tooling constraints in machining undercut faces 40*a* and 40*b* of the slide 20 above said bosses. Additionally, the bosses 36 act to constrain tilt of the breechblock 21, and provide a bearing surface 41 for face 32*b*. In a broken-out view, FIG. 5 shows the extractor 42 housed in the breechblock 21. If the slide 26 overtakes the breechblock 21, or when manually actuated, the extractor leg 43 contacts face 44 in the slide 20, pulling the breechblock 21 rearward. In order to remove the breechblock 21 from the slide assembly 20, the extractor 42 must be rotated to the extent of its travel against its spring for the leg 43 to clear face 44 and allow the breechblock assembly 21 to be removed forward. The extractor 42 may be economically manufactured from a powdered grade of shock-resistant tool steel by means of metal injection molding. FIG. 6, in another broken-out section, shows the clearance cut 45 provided through which extractor leg 43 may pass during disassembly. An exploded barrel assembly 16 is shown in FIG. 7. In the preferred embodiment, diameter 47 of the barrel tube 46 is pressed into a bore 49 of the barrel shroud 48 to produce an interference fit. The press is stopped either on a shoulder or when the chamber-end face of the barrel tube 46 is flush with the rear face of the barrel shroud 48. The assembly is then crossdrilled at a vertical distance from the boreline as to intersect the outer diameter of the barrel tube 46 and a pin 50 is pressed through the drilled hole. Alternately, and if there is no need for clocked features, the barrel tube 46 could be threaded and torqued against a shoulder in the barrel shroud 48. This barrel shroud 48 features a MIL-STD-1913 Picatinny mounting rail 51 above the chamber, cuts 52 for weight reduction and increased heat dissipation, and a dovetail 53 for a front sight 54, though a front sight may be mounted by alternate means or be an integral part of the slide. An extractor 42 clearance cut 55*a* & 55*b* is present on both the barrel tube 46 and shroud 48 respectively, and may be postmachined on the assembly or machined in both parts separately and used to align any other features in the barrel tube 46 that may require clocking relative to the shroud 48, such as gas vent ports. The chambering marking 56 and proof marking may be marked on the barrel shroud 48 after assembly and proof firing. The forward, smaller diameter 57 of the barrel tube 46 may be held in clearance in order to free-float this section and reduce unwanted effects on point-of-impact due to the presence or absence of extra features on the barrel shroud 48. An alternate barrel assembly 58 is presented as assembled in a firearm in FIG. 8. This barrel assembly 58 is longer, having a direct optic mounting interface 59 instead of a Picatinny rail, and is vented 60 near the muzzle for recoil compensation. In a preferred embodiment of the invention, said barrel assembly 58 and full-size magazine 25 are the only parts needed to convert the universal action, consisting of receiver assembly 1*a*, grip frame 10, and slide assembly 20, from a compact pistol configuration to a full-size or duty pistol configuration. The barrel shroud protrudes downwards below the muzzle and features additional Picatinny rail slots 61 as a continuation of those found on grip frame 10. Yet another barrel assembly 62 is shown in FIG. 9, as a partial cross section. The barrel tube 46 terminates inside a shroud 63 having a bore for the projectile and a cavity interrupted by baffles 64 typical of existing sound suppressors, which act to accumulate gas and pressure, reducing audible report and muzzle flash. In the preferred embodiment, this integrally-suppressed barrel shroud 63 may be manufactured by additive methods, e.g. laser sintering of hardenable steel, nickel-based, or preferably titanium alloy, with tolerance-critical features being postmachined into the sintered part. Barrel assemblies for the firearm in the invention may feature any combination of but not limited to the shown features, and allow the universal action to be configured by the user to fulfill a plurality of different requirements. FIG. 10 shows another embodiment of the invention, in which the universal action is provided a carbine-type barrel assembly 65 mounted within an upper receiver 66 and possessing a flash hider 67. The upper receiver may be attached directly to the barrel shroud with fasteners such as screws 68 or pins and needs no recoil lug, since the only axial firing loads seen by the barrel are engraving force and any possible net force of a muzzle break, compensator, or sound suppressor. The upper receiver 66 shrouds the slide 20 and may possess attributes typical of modern carbines, including a full length Picatinny accessory rail 69, negative-space accessory mounting slots 70, an ejection port 71 and a charging handle 72. The upper receiver 66 may economically be formed from an aluminum alloy extrusion to form most of the net shape of the profile. The receiver assembly 1*a* is additionally installed in an extended grip 73 with a telescoping stock or brace 74, which may also be used with almost any other combination of components. This configuration allows the firearm to adopt characteristics of a subcarbine, personal defense weapon, or submachine gun at no penalty to proper function of the mechanism.

What is claimed is:

1. A modular firearm system for a pistol cartridge comprising:

a unitary receiver housing a trigger, fire control components, and having locking surfaces;

a barrel assembly removably secured to the receiver and is stationary relative to the receiver during firearm operation;

a slide assembly that traverses guide rails of the receiver or barrel assembly, having a breechblock assembly disposed therein and configured to amplify the inertia of the slide when subject to firing loads, said locking surfaces of the receiver acting as a fulcrum with which a lever may amplify acceleration of the breechblock into the slide;

a grip frame assembly that removably houses the receiver.

2. A firearm system as in claim 1, wherein the barrel assembly is removably secured within the slide assembly when said slide assembly is removed from the receiver assembly.

3. A firearm system as in claim 1, wherein the breechblock assembly includes a pivoting extractor with a claw end and a tail end, and one or more ends is configured to prevent disassembly of the breechblock assembly from the slide unless pivoted beyond a certain point.

4. A firearm system as in claim 1, wherein locking surfaces in the receiver assembly serve as a fulcrum against which the breechblock, having bearing faces on the upper and lower rear corners, acts as a camming lever to transmit firing forces to the slide, amplifying the acceleration of the breechblock by means of differential horizontal and vertical movement of the breechblock camming against said locking surfaces on a bottom rear bearing face and camming against a corresponding face in the slide on a top rear bearing face.

5. A firearm system as in claim 4, wherein the camming faces of the receiver and slide are angled between 55 and 35 degrees from the bore axis.

6. A firearm system as in claim 4, wherein the slide is configured to prevent cartridges in the magazine from contacting the bottom face of the breechblock.

7. A barrel assembly as in claim 1, characterized by either monolithic construction or a barrel tube mounted rigidly inside a barrel shroud.

8. A barrel assembly as in claim 7, wherein the barrel has a length in a range of about 3.5 to 10 inches.

9. A barrel assembly as in claim 7, wherein the barrel has vents to divert muzzle gas to provide a compensatory effect against muzzle rise.

10. A barrel assembly as in claim 7, wherein the barrel terminates within a shroud comprised of internal cavities, baffles, and of a bore through which the projectile may travel in clearance, said bore intersecting internal cavities and baffles to retard bore depressurization and reduce audible and visual muzzle signature.

11. The barrel assembly as in claim 10, wherein the barrel shroud is of monolithic construction.

12. A barrel assembly as in claim 7, having one or more interfaces to which optics, sighting systems, and accessories may be directly mounted.

13. A barrel assembly as in claim 7, wherein the barrel assembly is mounted within an upper receiver assembly, which surrounds the slide assembly and provides a means of charging the slide.

14. An upper receiver assembly as in claim 13, wherein the means of charging the slide is not rigidly linked to the slide during firing.

15. A grip frame assembly as in claim 1 comprised of a pistol grip capable of receiving a magazine, and one or more strut connecting the pistol grip to a buttstock or arm brace.

16. A modular firearm system for a pistol cartridge comprising:

a unitary receiver housing a trigger and fire control components;

a barrel assembly removably secured to the receiver, is stationary relative to the receiver during firearm operation, and having locking surfaces;

a slide assembly that traverses guide rails of the receiver or barrel assembly, having a breechblock assembly disposed therein and configured to amplify the inertia of the slide when subject to firing loads, said locking surfaces of the barrel extension acting as a fulcrum with which a lever may amplify acceleration of the breechblock into the slide;

a grip frame assembly that removably houses the receiver.

17. A firearm system as in claim 16, wherein the slide assembly is removably secured within the barrel assembly when said barrel assembly is removed from the receiver assembly.

18. A firearm system as in claim 16, wherein locking surfaces in the barrel assembly serve as a fulcrum against which the breechblock, having bearing faces on the upper and lower rear corners, acts as a camming lever to transmit firing forces to the slide, amplifying the acceleration of the breechblock by means of differential horizontal and vertical movement of the breechblock camming against said locking surfaces on a top rear bearing face and camming against a corresponding face in the slide on a bottom rear bearing face.

19. A barrel assembly as in claim 16, wherein the barrel has a length in a range of about 3.5 to 10 inches.

20. A barrel assembly as in claim 19, having one or more interfaces to which optics, sighting systems, and accessories may be directly mounted.

* * * * *